United States Patent [19]

Elston, III et al.

[11] Patent Number: 4,743,166

[45] Date of Patent: May 10, 1988

[54] BLADE ROOT SEAL

[75] Inventors: Sidney B. Elston, III; Robert J. Corsmeier; Melvin Bobo, all of Cincinnati, Ohio

[73] Assignee: General Electric Company, Cincinnati, Ohio

[21] Appl. No.: 684,435

[22] Filed: Dec. 20, 1984

[51] Int. Cl.[4] ..... F01D 5/30

[52] U.S. Cl. ..... 416/215; 416/193 A; 416/500

[58] Field of Search ..... 416/215, 216, 217, 220 R, 416/221, 219 R, 500, 193 A

[56] References Cited

U.S. PATENT DOCUMENTS

| | | | |
|---|---|---|---|
| 2,310,412 | 2/1943 | Flanders | 416/500 |
| 2,936,155 | 5/1960 | Howell et al. | 416/500 |
| 3,216,700 | 11/1965 | Bostock, Jr. | 253/77 |
| 3,292,900 | 12/1966 | Petterson | 416/500 |
| 3,689,177 | 9/1972 | Klassen | 416/220 R |
| 3,918,842 | 11/1975 | Longley et al. | 416/219 |
| 4,019,832 | 4/1977 | Salemme et al. | 416/193 A |
| 4,029,436 | 6/1977 | Shoup, Jr. et al. | 416/193 A |
| 4,177,013 | 12/1979 | Patterson et al. | 416/193 A |
| 4,183,720 | 1/1980 | Brantley | 416/193 A |
| 4,280,795 | 7/1981 | Trousdell | 416/218 |
| 4,326,835 | 4/1982 | Wertz | 416/193 A |
| 4,422,827 | 12/1983 | Buxe et al. | 416/193 A |
| 4,464,096 | 8/1984 | Trousdell et al. | 416/221 |
| 4,480,957 | 11/1984 | Patel et al. | 416/220 R |
| 4,494,909 | 1/1985 | Forestier | 416/500 |
| 4,505,642 | 3/1985 | Hill | 416/193 A |

FOREIGN PATENT DOCUMENTS

| | | | |
|---|---|---|---|
| 1953711 | 4/1970 | Fed. Rep. of Germany | 416/193 A |
| 2250563 | 5/1973 | Fed. Rep. of Germany | 416/193 A |
| 0800569 | 8/1958 | United Kingdom | 416/216 |
| 2139295 | 11/1984 | United Kingdom | 416/193 A |

*Primary Examiner*—Robert E. Garrett
*Assistant Examiner*—John Kwon
*Attorney, Agent, or Firm*—Douglas S. Foote; Derek P. Lawrence

[57] ABSTRACT

A rotor assembly comprising a disk, blade, and seal is disclosed. The disk has a circumferential blade retaining slot disposed therein. The blade includes an airfoil and root separated by a platform so that the root is mountable within the slot and the platform extends beyond the root to first and second opposite ends. The seal generally contacts the slot and platform and extends circumferentially from the root to the first end.

7 Claims, 2 Drawing Sheets

BLADE ROOT SEAL

This invention relates generally to gas turbine engines and, more particularly, to a seal for preventing air leakage under blade platforms and between blade roots.

BACKGROUND OF THE INVENTION

Turbomachinery, such as gas turbine engines, typically includes one or more rotor assemblies with circumferentially spaced blades mounted on an annular structure or disk. For example, axial flow gas turbine engines include a compressor section with one or more rotor assemblies for compressing air moving through the engine. Each compressor blade may include an airfoil and root separated by a platform. Various configurations for the root are known, with a dovetail shape being a paradigm. Each such dovetail root is mounted in the disk by means of either an axial slot or circumferential slot in the disk.

The present invention relates to dovetail roots mounted in a circumferentially extending slot. In order to reduce weight and ease mounting problems, such dovetails do not extend circumferentially as far as the overlying platform. This provides a gap between adjacent blade dovetails.

In axial flow compressors, air passing through a blade row increases in pressure. Gaps, such as described above, under blade platforms and between adjacent dovetails provide a leakage path through which the higher pressure air may backflow to the region of lower pressure. Such recirculation reduces compressor and overall engine efficiency.

OBJECTS OF THE INVENTION

It is an object of the present invention to provide a new and improved blade root seal.

It is another object of the present invention to provide a low cost and effective seal for circumferential dovetail roots.

It is a further object of the present invention to provide a circumferential blade root seal which is light weight, easy to install, and highly effective for reducing gas leakage.

SUMMARY OF THE INVENTION

In accordance with the present invention, a rotor assembly comprises a disk, a blade, and a seal. The disk has a circumferential blade retaining slot disposed therein. The blade includes an airfoil and root separated by a platform. The root is mountable within the slot and the platform extends circumferentially beyond the root to first and second opposite ends. The seal generally contacts the slot and platform and extends circumferentially from the root to the first end.

In another form of the present invention, the seal extends circumferentially to adjacent blade roots.

DETAILED DESCRIPTION OF THE INVENTION

Figure 1:
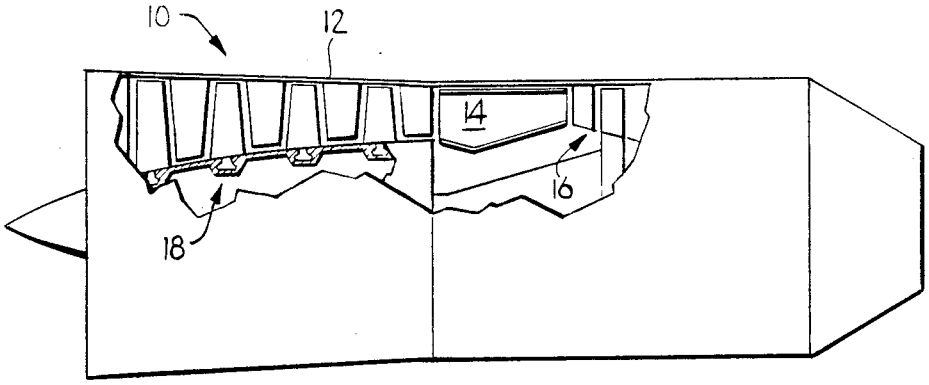
FIG. 1 is a view of a gas turbine engine embodying the present invention.

FIG. 1 discloses a gas turbine engine 10 which may advantageously employ the present invention. However, it will be understood that the invention is not limited to gas turbine engines, but applies equally to any axial flow turbomachine.

Gas turbine engine 10 includes a compressor section 12 for compressing air and a combustor 14 for mixing fuel with compressed air and igniting the mixture to form a high energy gas stream. Aft of combustor 14 is a turbine section 16 which may include one or more turbine rows for extracting energy from the gas stream. Although a preferred form of the present invention applies to compressor section 12, the invention may find useful application in turbine section 16 as well.

Figure 2:
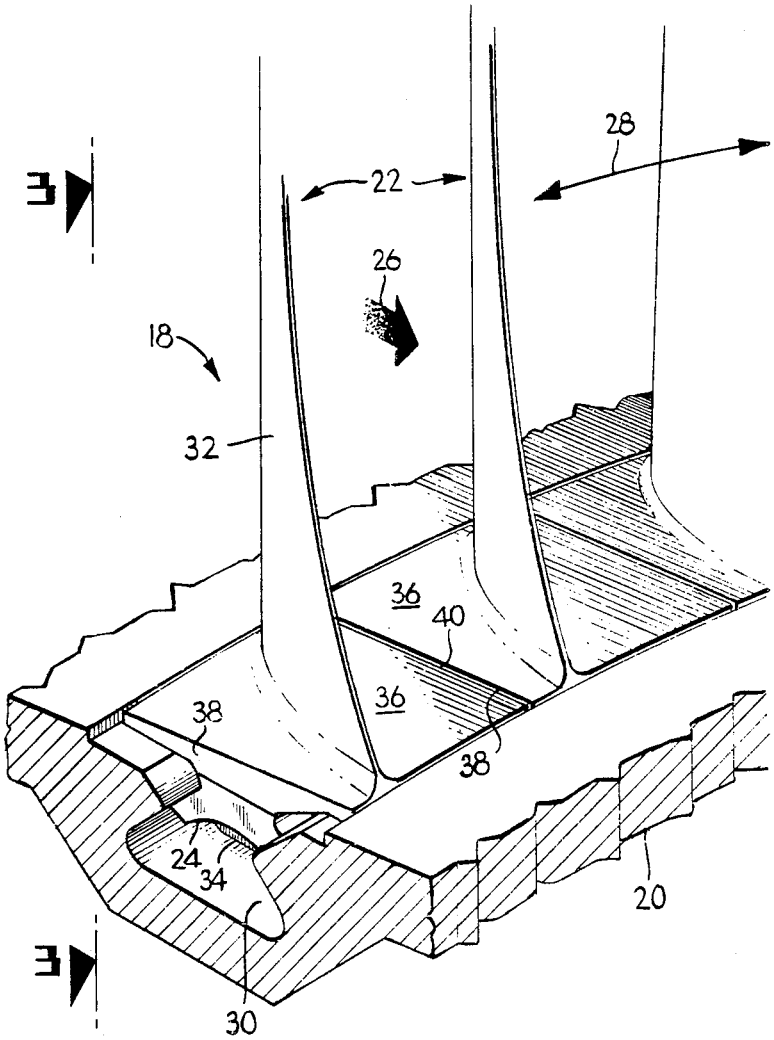
FIG. 2 is a perspective view of a rotor assembly according to one form of the present invention.

Compressor section 12 includes one or more rotor assemblies 18. A portion of rotor assembly 18 is shown in perspective view in FIG. 2. The assembly comprises a disk 20, one or more blades 22, and a seal member or seal 24. The orientation of blades 22 and disk 20 is such that air flows in a generally axially aft direction shown by arrow 26. Disk 20 is generally normal to flow 26 and extends circumferentially in a direction shown by arrow 28.

Disk 20 includes a circumferential blade retaining slot 30 disposed therein. In the embodiment shown, slot 30 has a dovetail shape. However, it will be clear that alternative slot configurations are within the scope of the present invention.

Each blade 22 includes an airfoil 32 and a root 34 separated by a platform 36. Platform 36 provides a surface for the smooth passage of airflow 26 thereover. Root 34 is mountable within slot 30 and is inserted therein through a loading slot (not shown). Platform 36 extends circumferentially beyond root 34 to first and second opposite ends 38 and 40, respectively. A plurality of blades 22 may be loaded into slot 30, as described more fully hereinafter. When completely assembled, adjacent blades 22 will be positioned so that platforms 36 of adjacent blades 22 abut one another at respective ends 38 and 40.

Figure 3:
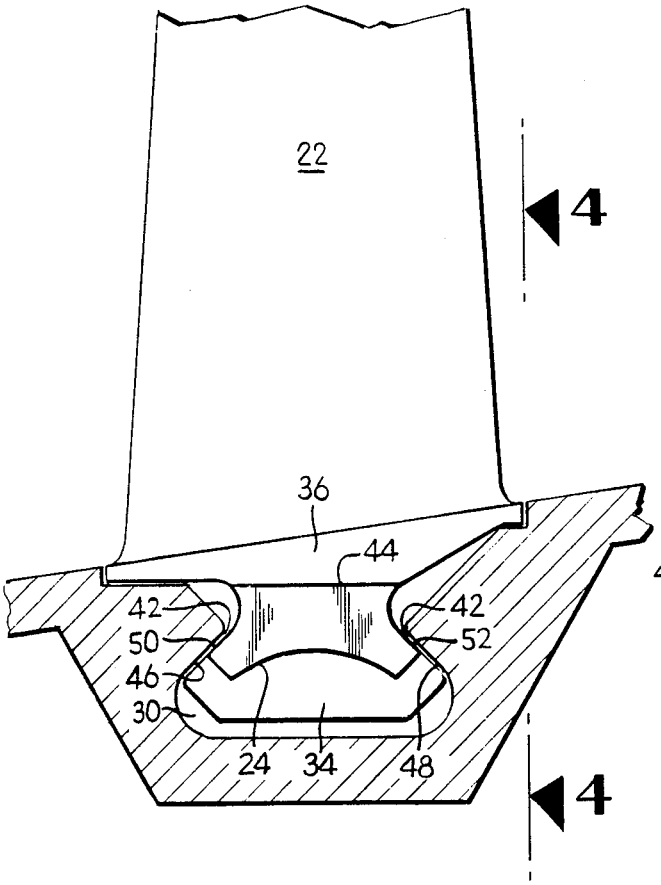
FIG. 3 is a view of a blade and seal taken in the direction of arrow 3 in FIG. 2.
Figure 4:
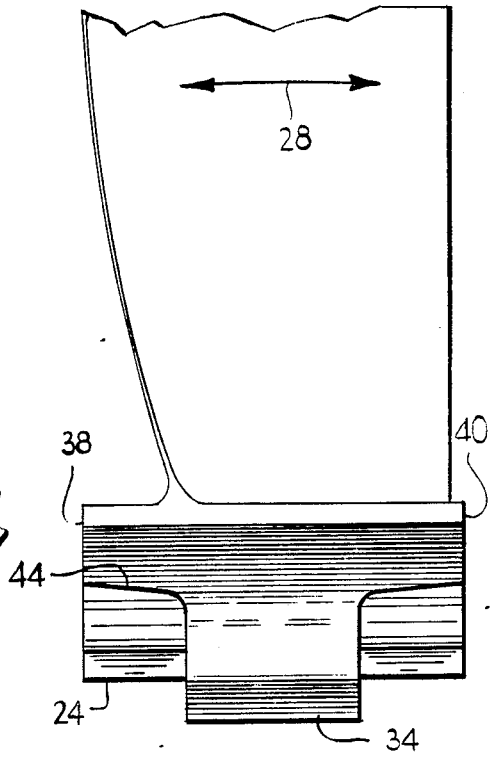
FIG. 4 is a sectional view taken in the direction of arrow 4—4 in FIG. 3 with disk removed for clarity.

As best shown in FIGS. 3 and 4, seal 24 generally contacts slot 30 and platform 36 at contact interfaces 42 and 44, respectively. Seal 24 extends in a circumferential direction 28 from root 34 to first end 38.

According to a preferred form of the present invention, circumferential slot 30 in disk 20 is dovetail shaped in axial cross section. As shown in FIG. 3, dovetail slot 30 has generally radially inward facing surfaces 46 and 48. Root 34 has a similar dovetail shape with radially outward facing surfaces 50 and 52. Each of faces 50 and 52 are mateable with surfaces 46 and 48, respectively. Seal 24 disposed in slot 30 between adjacent blade roots 34 is similarly mateable with inwardly facing surfaces 46 and 48 and is mateable with platform 36.

In the embodiment shown in FIG. 3, seal 24 is generally conformal in axial cross section with a radially outer portion of root 34. In a preferred embodiment, seal 24 is elastomeric. However, other materials with effective sealing properties may be advantageously employed and are within the scope of the present invention.

In operation, air 26 aft of blade 22 has a tendency to seek a leakage path under platform 36 and between adjacent blade roots 34 to a region of lower pressure forward of blades 22. Seal 24, in the presence of centrifugal forces, presses circumferentially against blade root 34 and radially against inwardly facing surfaces 46 and 48 of slot 30 and against platform 36 to prevent such leakage. Further, each seal 24 circumferentially abuts a similar seal to reduce leakage therebetween. It will be clear that the centrifugal forces on seal 24 during rotation of rotor assembly 18 tend to press seal 24 into tight contact with surfaces 46 and 48, platform 36 and abutting seals.

According to another form of the present invention, seal 24 may be permanently fastened to platform 36 and/or selected areas of the radially outer portion of root 34. In this manner, fewer pieces are handled during assembly. In the event that a blade loading slot of circumferential length equal to blade root 34 is employed, the blade/seal assembly may be loaded by dropping root 34 through such slot while simultaneously pinching outer surfaces 50 and 52 of elastomeric seal 24 to permit entry into slot 30. It may be necessary to employ locking lugs and corresponding locking slots in slot 30 to prevent circumferential movement of blades 22. For example, U.S. Pat. No. 3,216,700—Bostock, Jr., discloses one form of a locking lug and slot which may be employed with the present invention. It is clear that there may be some leakage around such lugs. However, since only one or two locking lugs are typically employed in one blade row, the amount of leakage therethrough is insignificant.

Figure 5:
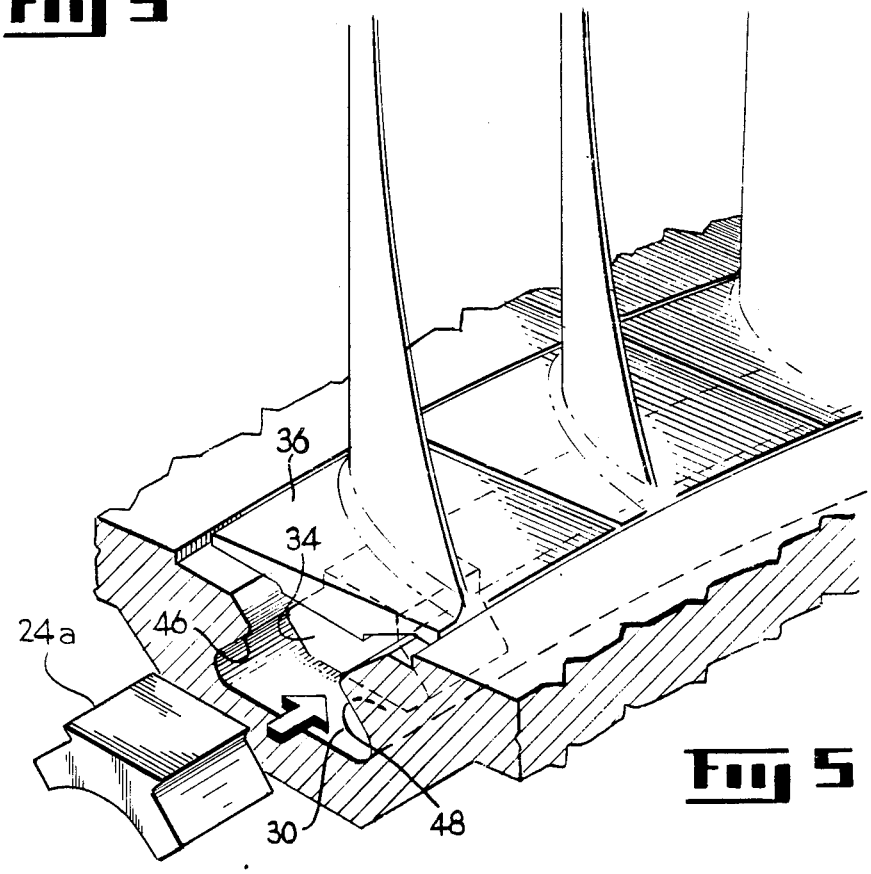
FIG. 5 is a perspective view of a rotor assembly according to an alternative form of the present invention.

FIG. 5 shows an alternative form of the present invention. In this embodiment, a seal **24*a* which is generally twice the circumferential length of seal members 24 is employed. As with seal member 24, seal 24*a* generally contacts slot 30 and platform 36, but extends circumferentially to adjacent blade root 34**.

In operation, seal **24*a* presses against platform 36, radially inward facing surfaces 46 and 48 of slot 30, and adjacent blade roots 34 to reduce the flow of fluid under platform 36 and between adjacent blade roots 34. In addition to the effective sealing properties of seal members 24 and seal 24*a*, each demonstrates a further advantage of resiliently damping vibrations induced in blades 22**.

It will be clear to those skilled in the art that the present invention is not limited to the specific embodiments described and illustrated herein. Nor is the invention limited to compressors or turbine rotors. Rather, the invention applies equally to any assembly wherein a plurality of airfoils are mounted in a circumferentially extending slot. For example, the invention applies equally to stator assemblies.

It will be understood that the dimensions and proportional and structural relationships shown in the drawings are illustrated by way of example only and those illustrations are not to be taken as the actual dimensions or proportional structural relationships used in the rotor assembly of the present invention.

Numerous modifications, variations, and full and partial equivalents can now be undertaken without departing from the invention as limited only by the spirit and scope of the appended claims.

What is desired to be secured by Letters Patent of the United States is the following.

What is claimed is:

1. A rotor assembly comprising:

a disk with a circumferential blade retaining slot disposed therein;

a blade including an airfoil and root separated by a platform, wherein said root is mountable within said slot and wherein said platform extends circumferentially beyond said root to first and second opposite ends; and a seal generally contacting said slot and platform and extending circumferentially from said root to said first end, wherein said seal is generally conformal in axial cross section with a radially outer portion of said root.

2. An assembly, as recited in claim 1, wherein said seal is elastomeric.

3. A rotor assembly comprising:

a disk with a circumferential blade retaining slot disposed therein;

adjacent blades, each including an airfoil and root separated by a platform, wherein each root is mountable within said slot and wherein each platform extends circumferentially beyond said root to abut the platform of an adjacent blade; and a seal generally contacting said slot and platform and extending circumferentially to adjacent blade roots, wherein said seal is generally conformal in axial cross section with a radially outer portion of said root.

4. An assembly, as recited in claim 3, wherein said seal is elastomeric.

5. A rotor assembly comprising:

a disk with a circumferential dovetail slot disposed therein, said slot having generally radially inwardly facing surfaces;

adjacent blades, each including an airfoil and dovetail root separated by a platform, said root having generally radially outwardly facing surfaces mateable with said inwardly facing surfaces, wherein said platform extends circumferentially beyond said root; and a seal disposed in said slot between adjacent blade roots and mateable with said inwardly facing surfaces and said platform to reduce the flow of fluid therethrough;

wherein said seal is generally conformal in axial cross section with a radially outer portion of said dovetail root.

6. A rotor assembly, as recited in claim 5, wherein said seal comprises two seal members, each fastened to adjacent blade roots.

7. A rotor assembly, as recited in claim 5, wherein said seal is elastomeric.

* * * * *